US009021969B1

(12) United States Patent
Roberts

(10) Patent No.: US 9,021,969 B1
(45) Date of Patent: May 5, 2015

(54) MULTI-SPOOL THREADER

(76) Inventor: Penny Roberts, Fort Madison, IA (US)

( * ) Notice: Subject to any disclaimer, the term of this patent is extended or adjusted under 35 U.S.C. 154(b) by 0 days.

(21) Appl. No.: 13/466,029

(22) Filed: May 7, 2012

Related U.S. Application Data

(60) Provisional application No. 61/483,147, filed on May 6, 2011.

(51) Int. Cl.

| | |
|---|---|
| ***D05B 11/00*** | (2006.01) |
| ***D05B 43/00*** | (2006.01) |
| ***H02J 7/00*** | (2006.01) |
| *B65H 57/00* | (2006.01) |

(52) U.S. Cl.
CPC ..... *H02J 7/0029* (2013.01)

(58) Field of Classification Search
USPC ..... 112/475.01, 475.17, 302, 255, 117; 242/570
See application file for complete search history.

(56) References Cited

U.S. PATENT DOCUMENTS

| | | | | | |
|---|---|---|---|---|---|
| 3,067,704 | A * | 12/1962 | Pedersen | 112/254 |
| 3,072,081 | A * | 1/1963 | Milligan et al. | 112/470.07 |
| 3,312,184 | A * | 4/1967 | Cash | 112/118 |
| 3,776,157 | A * | 12/1973 | Szostak | 112/162 |
| 4,579,615 | A * | 4/1986 | Hanyu et al. | 156/159 |
| 5,269,244 | A * | 12/1993 | Cataletto | 112/302 |
| 5,603,462 | A * | 2/1997 | Conrad et al. | 242/554.2 |
| 5,682,830 | A * | 11/1997 | Katou et al. | 112/225 |
| 5,694,873 | A * | 12/1997 | Wu | 112/302 |
| 5,829,711 | A * | 11/1998 | Wu | 242/594 |
| 5,873,318 | A * | 2/1999 | Bohlinger et al. | 112/475.08 |
| 5,881,660 | A * | 3/1999 | Hiramatsu et al. | 112/302 |
| 5,913,485 | A | 6/1999 | Bruffett | |
| 6,044,782 | A | 4/2000 | Fressemann et al. | |
| 6,845,725 | B2 * | 1/2005 | Takei et al. | 112/475.08 |
| 7,025,302 | B1 | 4/2006 | Morkovsky | |
| 7,111,568 | B1 * | 9/2006 | Sakuma et al. | 112/247 |
| 2003/0079666 | A1 * | 5/2003 | Barrus | 112/117 |
| 2006/0150880 | A1 * | 7/2006 | Prufer et al. | 112/302 |

FOREIGN PATENT DOCUMENTS

| | | | |
|---|---|---|---|
| JP | 04084990 | A * | 3/1992 |
| JP | 04338487 | A * | 11/1992 |

* cited by examiner

*Primary Examiner* — Ismael Izaguirre
(74) *Attorney, Agent, or Firm* — Hamilton IP Law, PC; Jay R. Hamilton; Charles A. Damschen

(57) ABSTRACT

A spool of thread holder and threading device for holding a plurality of spools of thread, made up of a frame and a plurality of spool thread holders, said spool thread holders further comprising a rod, a base and a wing. The wing attaches to the rod along the axial length of said rod and the rod extends from the base. Each of the individual spool thread holders comprising the multiple spool thread holder, allows receipt of a spool of thread and the wing maintains the spool of thread adjacent the base. The frame is configured for attachment to a quilting machine to allow thread to unspool from each non-rotating spool of thread during operation under substantially equal tension.

5 Claims, 9 Drawing Sheets

MULTI-SPOOL THREADER

CROSS REFERENCE TO RELATED APPLICATIONS

This application claims the filing benefit under 35 U.S.C. §119(e) of provisional U.S. Pat. App. Ser. No. 61/483,147 filed on May 6, 2011, which is incorporated by reference herein in its entirety.

FIELD OF THE INVENTION

The present invention relates to a method and apparatus allowing improved distribution of thread for use in sewing with at least one thread spool. The invention allows for improved operation and blending of threads, including those of different colors or qualities, during operation of a long arm quilting machine.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. §1.171 (d)(c)

A portion of the disclosure of this patent document contains material which is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

DETAILED DESCRIPTION

Brief Description of Drawings

FIG. 4 A provides a detailed view of the single needle of the long arm quilting machine of FIG. 4 with multiple threads positioned in the needle.

DETAILED DESCRIPTION

Listing of Elements

Figure 1:
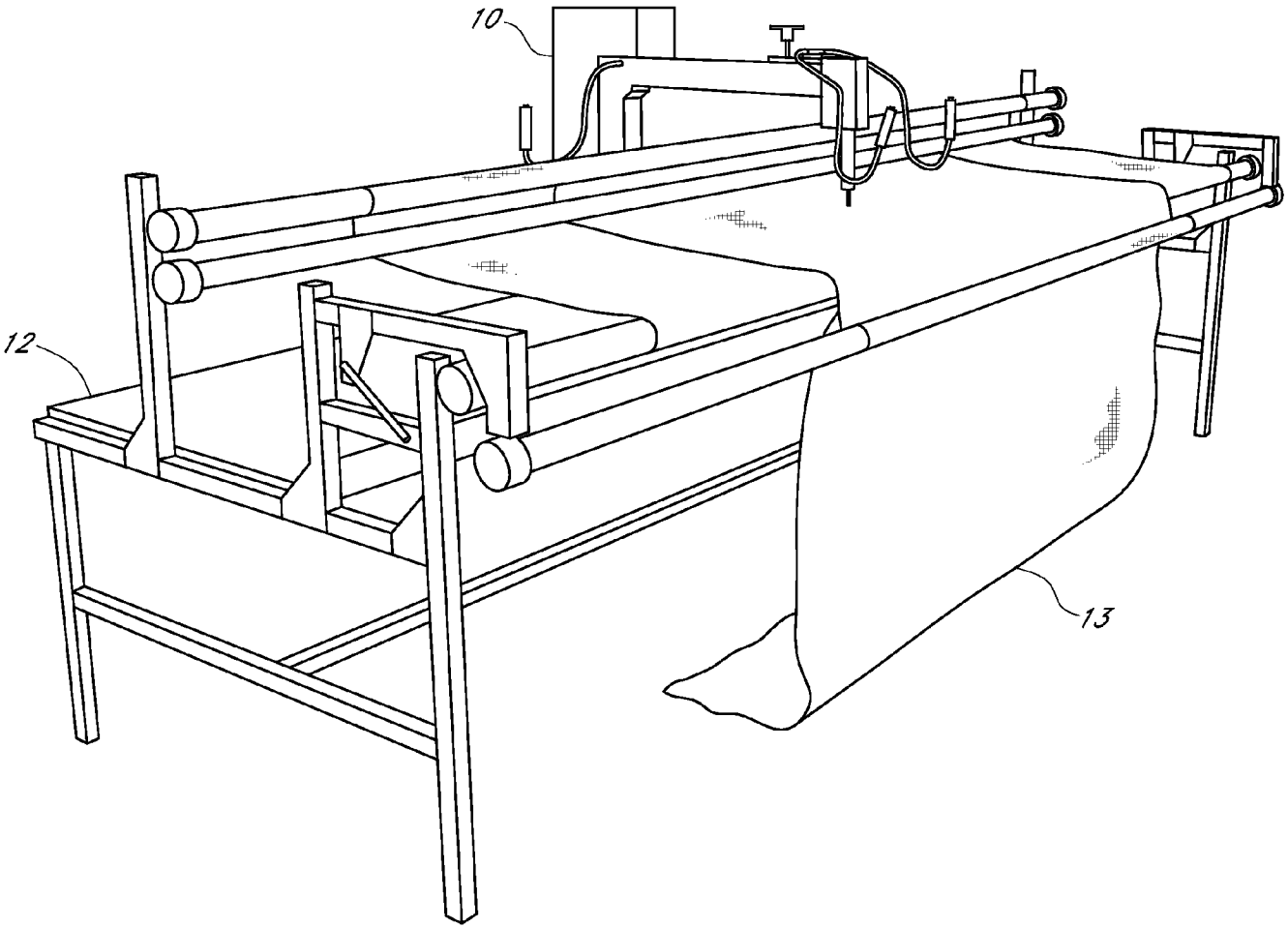
FIG. 1 provides a perspective view of a long arm quilting machine as assembled and in operation on a table.

| Element Description | Element Number |
|---|---|
| Frame | 1 |
| Spool Holder | 2 |
| Rod | 3 |
| Base | 4 |
| Wing | 5 |
| Cone (Spool of Thread) | 6 |
| Thread | 7 |
| Clamp | 8 |
| Deflected portion (of frame) | 9 |
| Long Arm Quilting Machine | 10 |
| Handle Arm | 11 |
| Table | 12 |
| Quilt | 13 |
| Single Spool Threader (prior art) | 14 |
| Multi-Spool Threader | 15 |
| Alternate Mounting Positions | 16 |
| Adhesive Portion | 17 |
| Body | 18 |
| Blank | 19 |
| Blank | 20 |
| Blank | 21 |
| 1st Thread Guide (2 holes) | 22 |
| Thread Post | 23 |
| Intermittent Tension | 24 |
| 2nd Thread Guide (3 holes) | 25 |
| Rotary Tension | 26 |
| Take Up Lever | 27 |
| Thread Guides | 28 |
| Needle | 29 |

Before the various embodiments of the present invention are explained in detail, it is to be understood that the invention is not limited in its application to the details of construction and the arrangements of components and elements set forth in the following description or illustrated in the drawings. The invention is capable of other embodiments and of being practiced or of being carried out in various ways not explicitly disclosed herein without departing from the scope and spirit of the present invention.

DETAILED DESCRIPTION OF INVENTION

Figure 2:
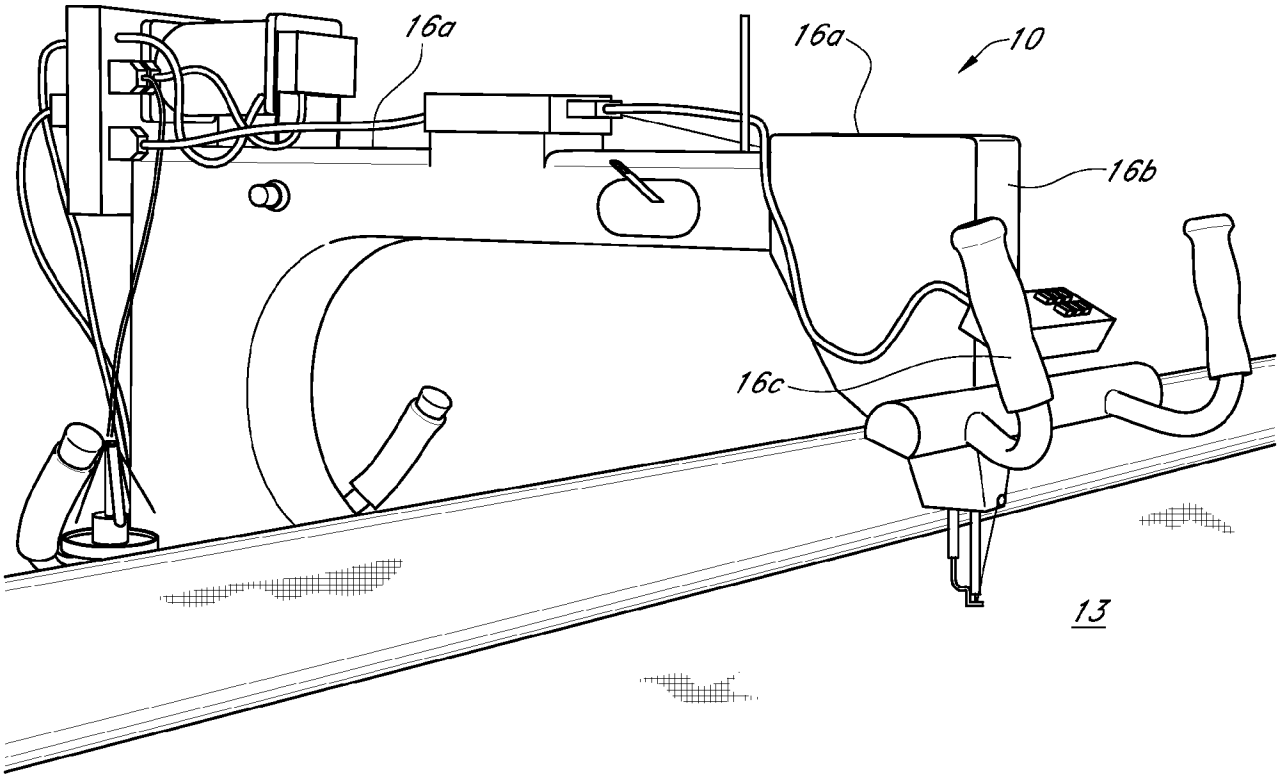
FIG. 2 provides a detailed side perspective view of a long arm quilting machine in operation.
Figure 3:
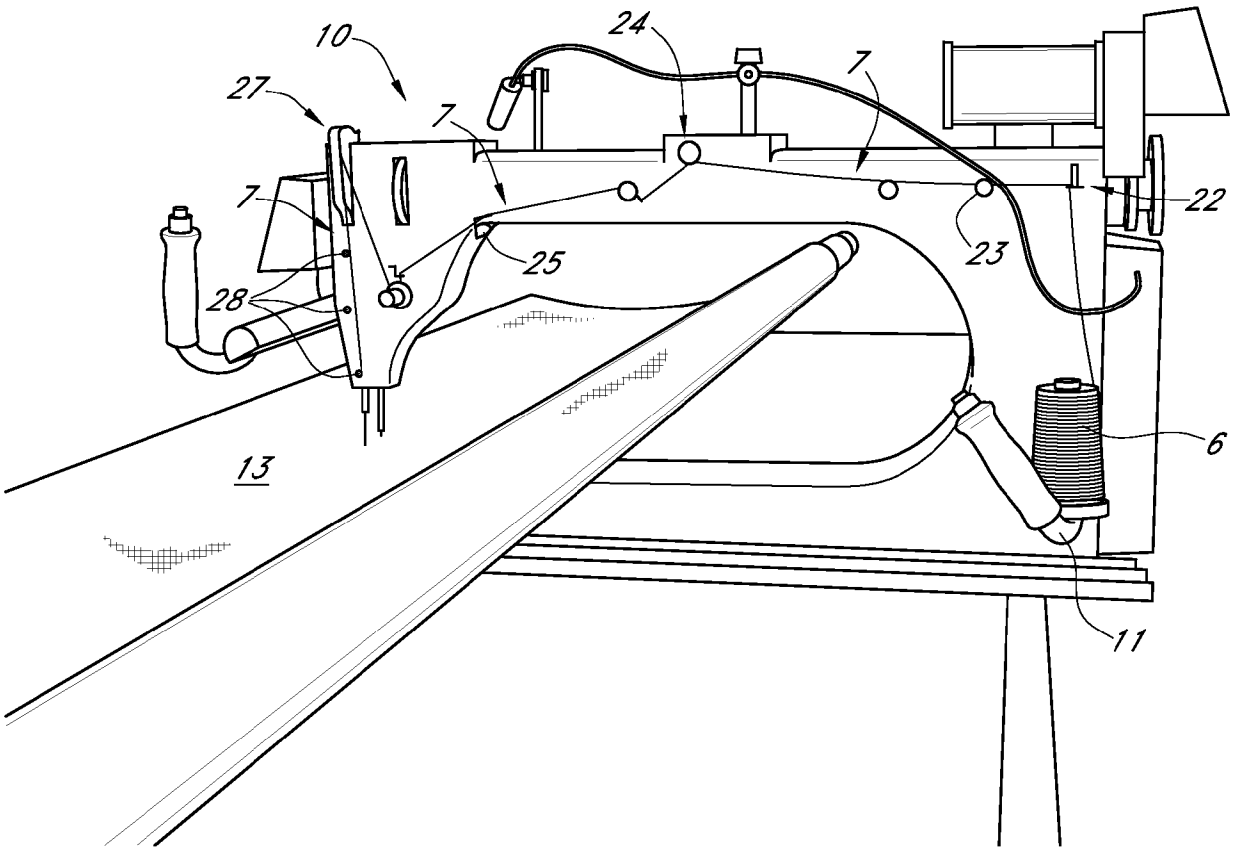
FIG. 3 provides a left side view of a long arm quilting machine manufactured by Gammil and branded as the "Classic" series upon which a threader, as is found in the prior art, is mounted.

Referring now to the drawings, wherein like reference numerals designate identical or corresponding parts throughout the several views, FIG. 1 provides a perspective view of a long arm quilting machine 10 as assembled and in operation on a table 12. FIG. 2 provides a detailed side perspective view of a long arm quilting machine 10 in operation. FIG. 3 provides a left side view of a long arm quilting machine 10 manufactured by Gammil and branded as the "Classic" series upon which a single spool threader 14, as is found in the prior art, is mounted. More information about operation of long arm quilting machines, such as the one shown, is publicly and readily available at www.gammill.com, which is incorporate by reference herein. Additionally, the Gammill Plus Service Manual, and in particularly section 8.6 "Timing the Sewing Hook" are instructional in the operation of this equipment and are incorporated by reference herein. The disclosure and incorporation of information regarding the Gammil brand of long arm quilting machines is for purposes of enablement and is for illustration purposes only, and is in no way meant to limit the present invention to one brand, embodiment or type of long arm quilting machine.

FIG. 3 demonstrates a prior art quilting machine used with a prior art single thread holder 14, the operator typically places the cone of thread 6 on the cone holder 14 of the prior art as shown in the lower right hand corner of FIG. 3. A portion of thread 7 is then pulled from the cone of thread 6 for insertion into thread guide 22, which typically has two holes, but is not limited as such. (not shown) Typically the first hole is parallel to the floor and the second is parallel to the wall. The operator should thread the first hole from bottom to top then thread the second hole from back to front. (not shown) The portion of thread 7 is then threaded from back to front through thread post 23 to the intermittent tension device 24 wherein the portion of thread 7 is threaded counter-clockwise through the intermittent tension device, approximately three-quarters of a turn. Although not shown, in some long arm quilting units, the thread will next be threaded counter-clockwise through a thread break sensor, approximately three-quarters of a turn. Portion of thread 7 is then inserted into and through thread guide 25. Although not shown in detail, typically thread guide 25 has three holes for convenience and to allow operator adjustment. Typically, during operation of the long arm quilting machine, all three holes are not used, and it is recommended that only the first and last holes are used. The first hole threaded from the bottom up and the third hole is threaded from the top down. (Not shown) Next, the thread portion 7 enters the rotary tension 26. The tread portion 7 goes over the first post and is wound clockwise around the rotary tension device 26, over the check spring and under the second post. The thread portion 7 is fed into the take-up lever 27 from back to front and is fed into the thread guides 28 from top to bottom. Finally, the thread portion 7 enters the needle 29 from the front to the back of the long arm quilting machine 10.

Figure 4:
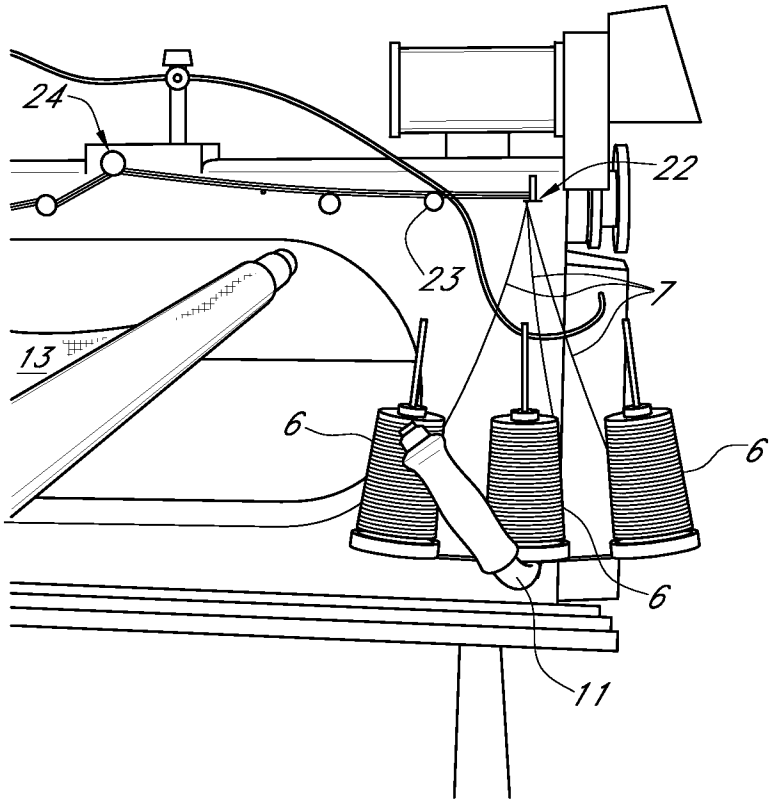
FIG. 4 provides a perspective view of the present art multi-spool threader mounted upon the long arm quilting machine illustrated in FIG. 3.

FIG. 4 provides a perspective view of the present art multi-spool threader 15 mounted upon the long arm quilting machine 10 illustrated in FIG. 3. As shown in FIG. 4, the multi-spool threader 15 is mounted upon the long arm quilting machine 10 handle arm 11 located at the rear of the long arm quilting machine 10. One of ordinary skill will appreciate that alternative mounting positions 16 and configurations are possible, including on top of the machine 16*a*, at the front of the machine 16*b* and upon the front via the operator guide handles 16*c*, without limitation, as illustrated as FIG. 3.

The multi-spool threader 15 functions as a supporter and threading device that allows for a plurality of threads (1-6), from a plurality of spools of threads (2-6), dependent upon the size of the spools, to be used by a threading device, such as a long arm quilting machine 10. The multi-spool threader 15 is comprised of a frame 1 upon which a plurality of individual spool thread holders 2 are affixed. The frame 1 may have several embodiments and configurations as shown at FIGS. 4 and 8.

Figure 5:
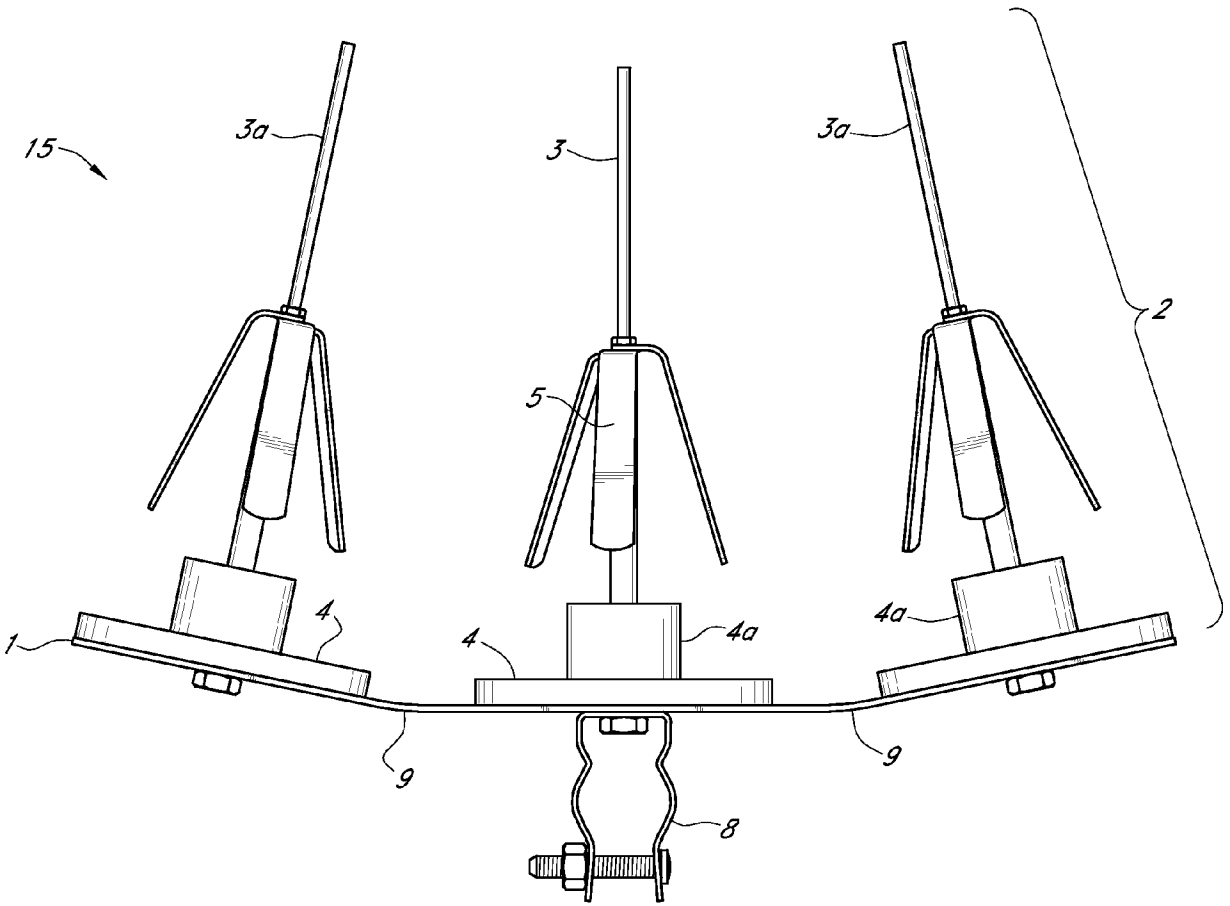
FIG. 5 provides a side view of the present art multi-spool threader wherein an attachment clamp is mounted under the center of the multi-spool threader frame.
Figure 6:
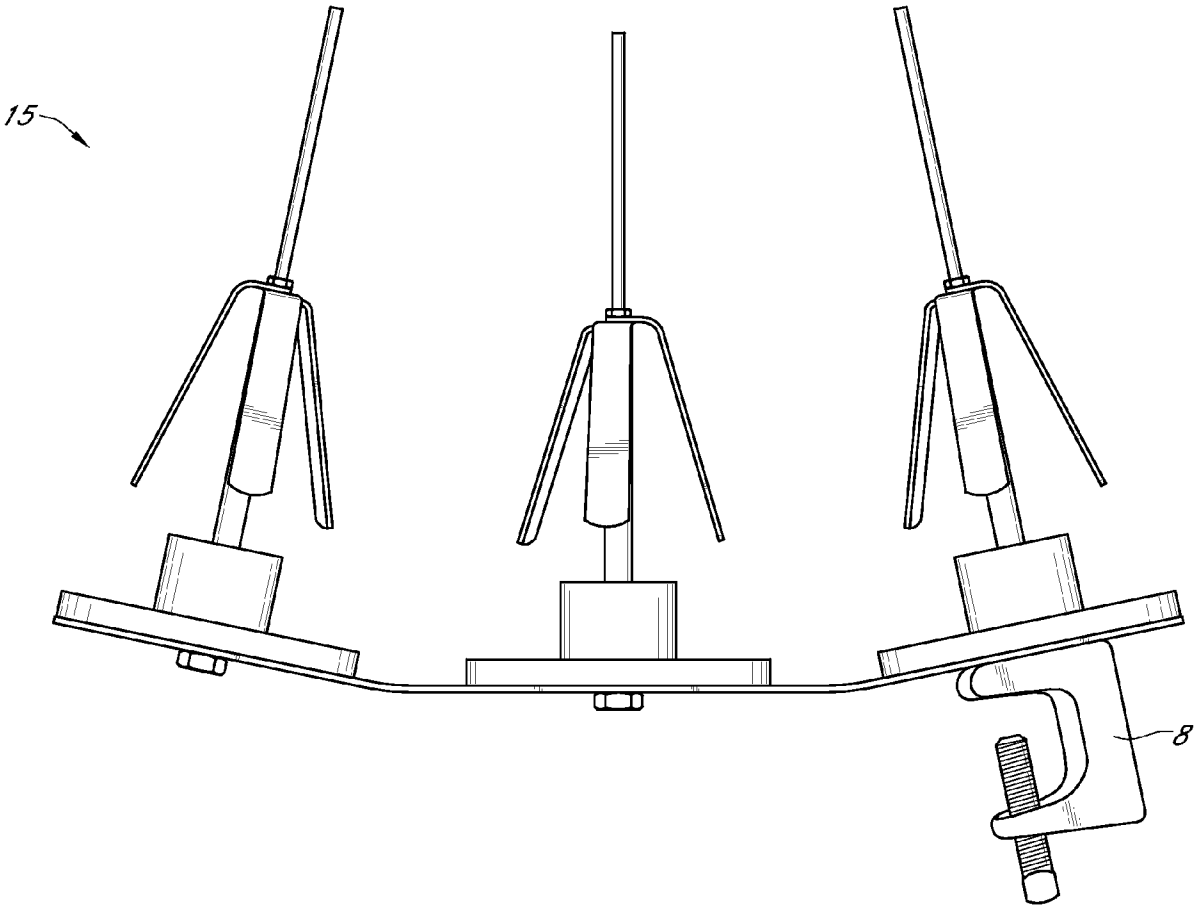
FIG. 6 illustrates another embodiment of the present art multi-spool threader wherein the attachment clamp is mounted at one end of the multi-spool threader frame.

In the embodiment of FIGS. 4-6, the spool thread holders 2 are comprised of a rod 3 affixed to and extending from a base 4. As illustrated in FIGS. 5-6, the frame 1 configuration allows the three (3) spool thread holders 2 shown to be aligned horizontally in a linear formation substantially parallel with the body of the long arm quilting machine 10. (See FIG. 4) In the embodiment shown in FIGS. 4-6, the frame portion is curved (deflected portion 9) allowing differences between the vertical heights of the spools (cones) of thread, and the point at which the thread portion 7 leaves the individual cones of thread 6 to enter the thread guide 22 of the long arm quilting machine 10. Additionally, in this embodiment, the spool thread holders 2 are composed of a frame 1 having three bases 4 attached to it with three rods 3 extending away from the frame 1 and bases 4. The multi-spool threader 15 may be affixed in several locations proximate to the long arm quilting machine 10. In FIG. 4, a clamp 8 is used to affix the middle of the frame 1 to the handle arm 11. The clamp 8 is shown in detail at FIG. 7. As shown in FIG. 5, the clamp 8 may be configured and used to attach either end of the multi-spool threader 15 to the handle arm 11. The clamp 8 as shown is only way of securing the multi-spool threader 15 proximate the long quilting machine body 18 and other ways are possible including fasteners, cables, adhesives and weldments.

Figure 8:
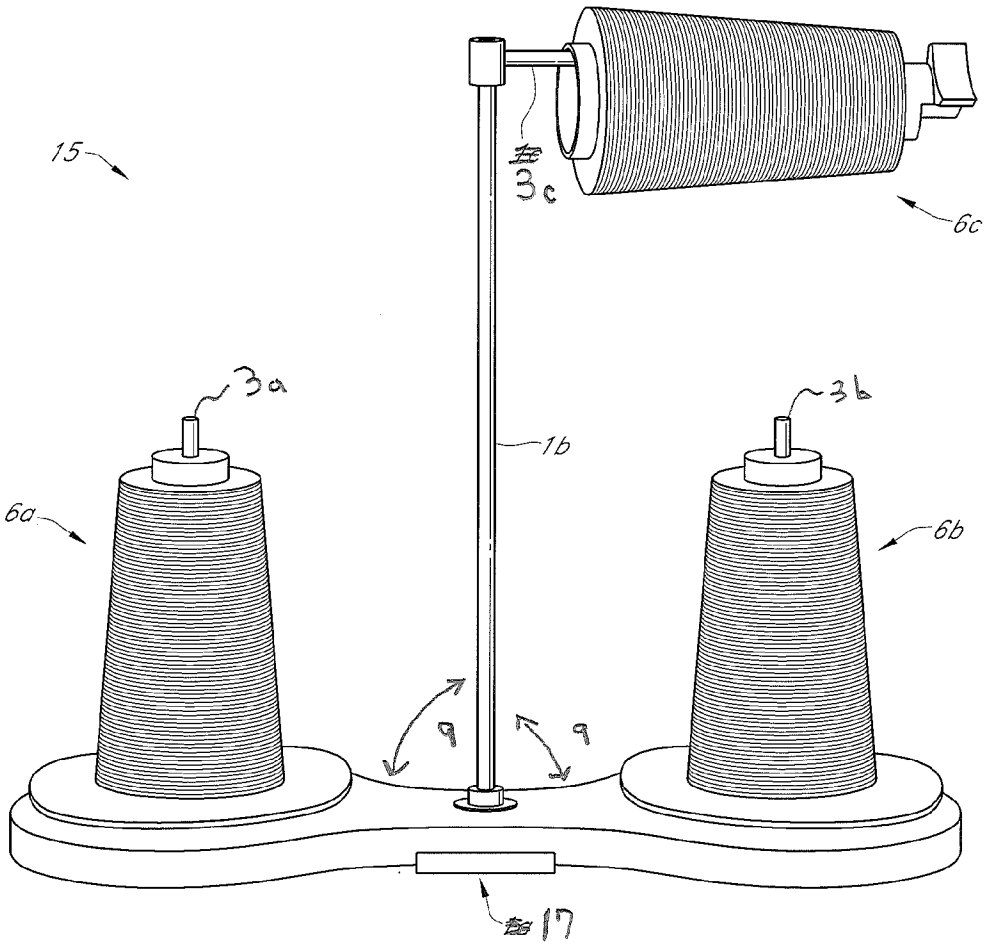
FIG. 8 illustrates another embodiment of the multi-spool threader.

As one of ordinary skill will appreciate, the multi-spool threader 15 may be constructed in several different ways, as exemplified by the embodiment shown at FIG. 8. In this embodiment, the frame portion 1 may be constructed of plastic and steel with a base 4 constructed of rubber with rods 3 extending away from the base 4 and frame (1*a*, 1*b*). In this embodiment, the deflected portion of the frame 9 is not curved and is positioned in the center of frame portion 1*a* to form a ninety (90) degree angle between portions of the frame 1*a* and 1*b*. A third spool of thread 6*c* may be engaged via the rod 3 affixed to the top portion of the frame 1*b*. In this configuration, the frame is affixed to the body of the long arm quilting machine using an adhesive portion 17.

Upon each rod 3 is typically affixed a wing 5. Typically, the wing 5 is attached to the rod 3 along the axial length of rod 3, proximate the midway point of the rod 3. The wing 5 typically improves engagement with the interior of the cone of thread and does not allow the cone of thread to rotate and maintains engagement with the multi-spool threader 15.

The rod 2 and frame 1 as illustrated are fabricated from steel but other materials, including aluminum or plastic will work as well.

As arranged, each said spool thread holder 2 allows for receipt and engagement of a spool of thread 6. It should be understood that a "spool of thread" to one of ordinary skill in the art is typically defined by the number of yards of thread wound onto the spool with an illustrative range being 300-600 yards. A "cone" of thread, on the other hand, may be understood by one of ordinary skill in the art to be defined as more than a thousand 1000 yards, possibly ranging up to 4000 yards or more of thread wound onto the cone shaped spool of thread. As used herein, "spool of thread" is meant to have its most basic definition as that of a cylinder of wood, plastic, cardboard, or other material on which wire, thread, or string is wound without limitation as to size or yardage.

As the production of a quilt typically requires a large number of yards of thread, it is desirable to be able to have multiple cones of thread feeding into the thread guide 22 of the long arm quilting machine 10. The wing 5 affixed to the rod 3 is configured to engage with and maintains the spool of thread 6 adjacent the base 4. (Illustrated at FIG. 5) The frame 1 may then be configured for attachment to a long arm quilting machine 10 to allow multiple threads 6 to unspool from each said non-rotating spool of thread 6 during operation under substantially equal tension. The wing 5 as illustrated is fabricated from aluminum using three separate pieces and functions to holds the spools of thread 6 on the rod 3 so they don't shift or change position. One of ordinary skill will appreciate other wing 5 configurations (not shown) will work to engage and fix the position of the spool of thread 6 and in no way is the present disclosure limiting. Other materials, such as steel or plastic may be chosen for the wing 5 without limiting function or application. Furthermore, the frame 1, rod 3, base 4 and wing 5 made be constructed as one-piece using conventional fabrication methods such as injection molding or casting.

As shown in the preceding figures, three large cones of thread may be used with the multi-spool threader 15. Modification of the arrangement shown could also allow use of two cones of thread up to five cones of thread. (Not shown) Additionally, another three small rolls of thread may be used by positioning the small rolls onto the rods with the three large cones of threads (not shown). In another version, the number of spool holders may be increased to as many as six (6), if the spacing upon the frame 1 is altered to allow for smaller rolls of thread versus larger cones of thread. As one of ordinary skill in the art will appreciate, to accommodate a large number of small diameter spools of thread, the distance between the spool holders 2 attached to the frame 1 must be reduced. FIG. 5 provides a side view of the present art threader wherein an attachment clamp 8 is mounted under the center of the multi-spool threader frame 1.

As illustrated in FIGS. 4-6, the frame 1 between each base 4 has a deflected portion 9. The amount of deflection in the frame 1 may be in the range of 1-10% producing an angle from horizontal of 1-20 degrees. As shown, and for illustration only, the frame 1 is composed of a piece of angle iron having a dimension of approximately 12 inches in length by 1 inch in width. The base 4 of the spool holders, as shown, and for illustration only, are fabricated from aluminum and have a diameter of three inches. The height of each base is approximately 1 inch. As shown, and for illustration only, the base may be implemented with a reduced diameter cone shape (4*a*), wherein the interior cone is approximately 1 inch in diameter. Each rod 3 as constructed, and without limitation, has a length of approximately 6.75 inches. The deflected portion 9, as shown and illustrated, and without limitation, is positioned in the frame 1, midway between the rods 3 affixed to the frame 1. The rods are affixed to the frame using threaded bolts but other means of securement, including casting or welding, may be used without limitation. As constructed, with the rods 3 having an equal length, and affixed to the frame 1 in an equivalent manner, results in the outer rods 3*a* extending approximately 0.25 to 0.5 inches further from the frame 1 than the center rod 3.

Figure 4A:
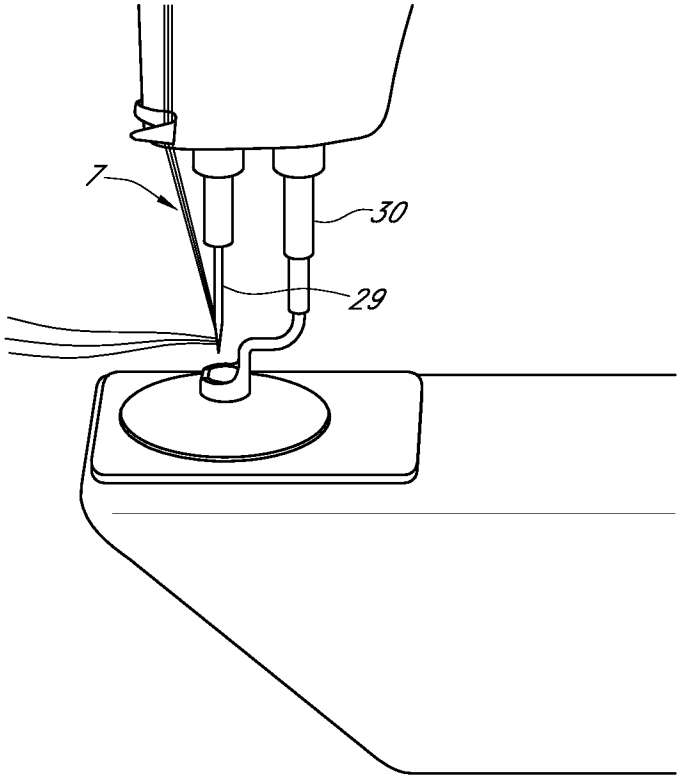

As result, the deflected portion of the frame 9 allows the thread 7 leaving each cone or spool of thread 6 to occupy spaces which are offset to one and other above the cone or spool of thread 6 prior to feeding into the thread guide 22 thereby reducing the potential for intersection or tangling of the threads reducing the potential for disruption in operations of the brig arm quilting machine 10. The threads 7, as illustrated in FIG. 4, as positioned by the multiple spool threader 15, affixed to handle arm, positioned proximate the long quilting machine body and each other, occupy different positions in the space around the long arm quilting machine while feeding to the same location on the long arm quilting machine, thread guide 22, such that multiple threads may be positioned in the needle 29 simultaneously, as shown in FIG. 4A. Thus, the individual threads occupy different spatial vectors prior to receipt by the thread guide 22 of the long arm quilting machine 10. As used herein, vector is defined as the Euclidean vector, meaning a geometric entity endowed with both length and direction; an element of a Euclidean vector space. Thereby reducing the potential for intersection or tangling of the threads reducing the potential for disruption in operations of the long arm quilting machine 10 caused by thread entanglement.

Figure 7:
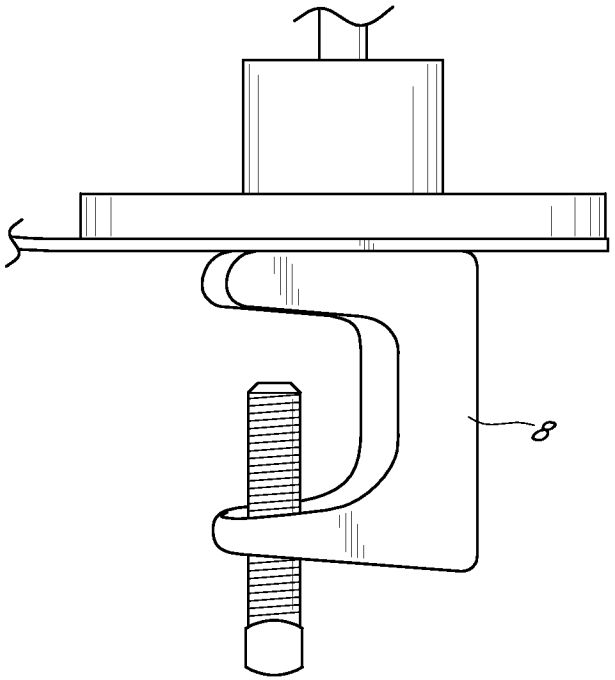
FIG. 7 provides a detailed side view of the embodiment illustrated in FIG. 6.

FIG. 6 illustrates another embodiment of the present art multi-spool threader 15 wherein the attachment clamp 9 is mounted at one end of the frame 1 of the multi-spool threader 15. FIG. 7 provides a detailed side view of the embodiment illustrated in FIG. 6 in which the clamp 9 is mounted at the end of the frame 1. It will be readily apparent to one of ordinary skill in the art that other methods of attachments of the frame 1 to the long arm quilting machine 10 are possible as previously discussed herein.

Although not shown, it should be apparent that the frame 1 need not be attached to the long arm quilting machine and instead it could be positioned adjacent to the long arm quilting machine 10 with its location, or the spatial relationship between the two, fixed via connection to a portion of the table 12 or a stand-alone type structure, not shown, without impairment to the present teachings or limiting the breadth of the claims or disclosure.

Illustrative Installation

First Embodiment

To install multi-spool threader 15, remove the original single spool holder (see FIG. 3) from your long arm quilting machine 10. Usually there is one or two screws and a bracket securing it from underneath. (Not shown) Remove the nut and bolt from the clamp 8 in the multi-spool threader 15, then gently slide the clamp 8 over the machine arm in its place. (See FIGS. 3-4) A piece of electrical tape may be placed on the arm, between the clamp and the arm, to protect the paint of the arm from scratches. Reinsert the bolt and tighten the nut snugly.

Illustrative Installation

Second Embodiment

To install the multi-spool threader 15, clean the upper or front portion (16*a* or 16*b*) of the body of the long arm quilting machine 10. Remove the paper from the adhesive backing and affix the multi-spool threader 15 to the clean portion of the body of the long arm quilting machine as shown in FIGS. 2 and 8.

It should be noted that the present invention is not limited to the specific embodiments pictured and described herein, but is intended to apply to all similar methods and apparatus for allowing the use of multiple spools of thread or cones of thread, or a combination of both, with a long arm quilting machine 10. Accordingly, modifications and alterations from the described embodiments will occur to those skilled in the art without departure from the spirit and scope of the present invention.

What is claimed is:

1. A single needle long arm quilting machine and a multi-spool threader for holding a plurality of spools of threads for use in blending multiple threads in a workpiece, the combination comprising:

a) A long arm quilting machine further comprising:

i) A powered sewing machine head configured with:

A) A top arm, said top arm having a single needle with a needle eye therein, a presser foot and at least a first thread guide and at least a second guide positioned therein, B) A bottom arm, said bottom arm and said top arm defining a throat therein for insertion of a workpiece, said bottom arm configured with a plurality of wheels therein, C) A power system connected to said powered sewing machine head to drive said single needle during sewing operations therein, ii) A worktable defining a workspace having a first dimension and a second dimension upon which to support said workpiece positioned between said top arm and said bottom arm and acted on by said powered sewing machine head during sewing operations;

iii) A plurality of rollers extending said first dimension and positioned across said second dimension to support said workpiece and allow lateral movement of said workpiece across said second dimension during sewing operations;

iv) A metal frame attached to and supporting said plurality of rollers and said work table;

v) A first set of tracks positioned across said metal frame and having length approximate said first dimension for engagement with said wheels positioned on said bottom arm of said powered sewing machine head allowing lateral movement across said first dimension of said worktable;

vi) A second set of tracks connected to said powered sewing machine head and positioned parallel with said plurality of rollers extending approximately the length of said second dimension for engagement with said plurality of wheels attached to said bottom arm of said powered sewing machine allowing movement along said second dimension;

b) A multi-spool threader further comprising:

i) A frame having a first end; a middle and a second end;

ii) A plurality of spool thread holders, each said spool thread holder further comprising:

1. A rod;

2. A base, said rod extending from said base; and, c) wherein said frame is configured for attachment to said long arm quilting machine to allow a single thread strand to unspool from a non-rotating spool of thread positioned on each said rod of said plurality of spool thread holders during sewing operations of said long arm quilting machine under substantially equal tension, for delivery of a plurality of said single thread strands simultaneously into and through at least said first thread guide and then at least said second guide positioned therein, prior to receipt in said needle of said single needle of said long arm quilting machine, wherein said needle eye of said single needle is sized to accept a plurality of said single thread strands.

2. The single needle long arm quilting machine and a multi-spool threader for holding a plurality of spools of threads for use in blending multiple threads in a workpiece, the combination according to claim 1 wherein said first end of said multi-spool threader frame and said second end of said multi-spool threader frame are angled relative to said middle of said multi-spool frame to allow said spools of thread to be positioned non-linearly in vertical relation to each other.

3. The single needle long arm quilting machine and a multi-spool threader for holding a plurality of spools of threads for use in blending multiple threads in a workpiece, the combination according to claim 1 wherein said multi-spool threader frame is configured to allow positioning of said spools of thread substantially linear to each other.

4. The single needle long arm quilting machine and a multi-spool threader for holding a plurality of spools of threads for use in blending multiple threads in a workpiece, the combination according to claim 1 wherein said multi-spool threader frame is configured to allow positioning of said spools of thread so that said thread is discharged from the top portion of each said spool of thread.

5. The single needle long arm quilting machine and a multi-spool threader for holding a plurality of spools of threads for use in blending multiple threads in a workpiece, the combination according to claim 1 wherein a wing is attached to said rod along the axial length of said rod to maintain the spool of thread adjacent to said base.

* * * * *